United States Patent [19]

Young, Jr. et al.

[11] Patent Number: 4,631,911

[45] Date of Patent: Dec. 30, 1986

[54] APPARATUS FOR REMOVING TWIST FROM MOVING FABRIC AND METHOD FOR ACCOMPLISHING SAME

[75] Inventors: William O. Young, Jr.; Julian E. Hankinson, Jr., both of Spartanburg, S.C.

[73] Assignee: Young Engineering Inc., Spartanburg, S.C.

[21] Appl. No.: 629,474

[22] Filed: Jul. 10, 1984

[51] Int. Cl.[4] ..... D04C 3/06; D04C 29/00; G01L 5/00

[52] U.S. Cl. ..... 57/1 UN; 8/151; 26/51; 26/74; 26/99; 57/31; 57/264; 73/159

[58] Field of Search ..... 57/1 UN, 1 R, 31, 32, 57/2.3, 2.5, 264; 26/1, 51, 71, 74, 99; 8/151, 151.1; 73/158, 159

[56] References Cited

U.S. PATENT DOCUMENTS

| | | | |
|---|---|---|---|
| 2,117,603 | 5/1938 | Dungler | 57/1 UN |
| 2,248,962 | 7/1941 | Cook | 57/1 UN |
| 2,759,324 | 8/1956 | Dean | 57/1 UN |
| 2,836,012 | 5/1958 | Moorhouse et al. | 57/1 UN |
| 3,533,144 | 10/1970 | Jaffe et al. | 57/1 UN X |
| 3,693,336 | 9/1972 | Bassani | 57/1 UN |
| 3,813,862 | 6/1974 | Tsuchida | 57/1 UN |
| 4,106,004 | 8/1978 | Kuroda | 57/1 UN X |
| 4,286,428 | 9/1981 | Bassani | 57/1 UN |
| 4,329,838 | 5/1982 | Zerle et al. | 57/1 UN |

FOREIGN PATENT DOCUMENTS

| | | | |
|---|---|---|---|
| 677647 | 8/1952 | United Kingdom | 57/1 UN |

*Primary Examiner*—John Petrakes
*Attorney, Agent, or Firm*—Dority & Manning

[57] ABSTRACT

Apparatus and method for removing real or false twist from a moving fabric in rope form. Freely rotatable, diagonally opposite elements are located on opposite sides of an fabric path of travel. Each element has a helically wound fabric contact member therearound with the helix direction of the diagonally opposite elements being the same. Fabric passing between the elements and engaging the contact members of the elements imparts rotation to the elements while the contact members impart rotation to the fabric for twist removal. A twist direction detector is located downstream of the elements to detect any remaining twist in the fabric, and a twist measurement sensor is located downstream of the twist detector to determine the amount of any remaining twist. The twist detector and twist measurement sensor are operatively associated with the elements such that relative position between the elements and the fabric may be controlled for greater or lesser twist removal, dependent upon output from the detector and sensor. Fabric being processed may be located on a rotatable turntable which may also be controlled by output from the detector and the sensor. In a preferred embodiment, a rotatably adjustable support is provided with two pairs of rolls mounted thereon for free rotation. Each pair of rolls define an acute angle therebetween and the fabric contact members on the rolls of each pair follow oppositely directed helices.

25 Claims, 8 Drawing Figures

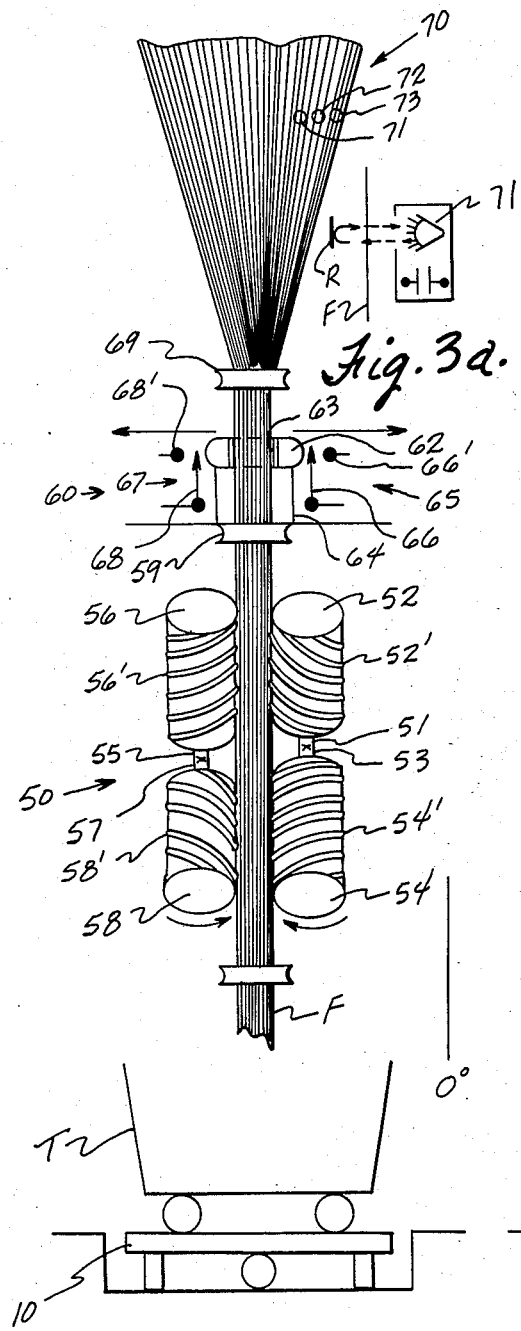
Fig. 3a.
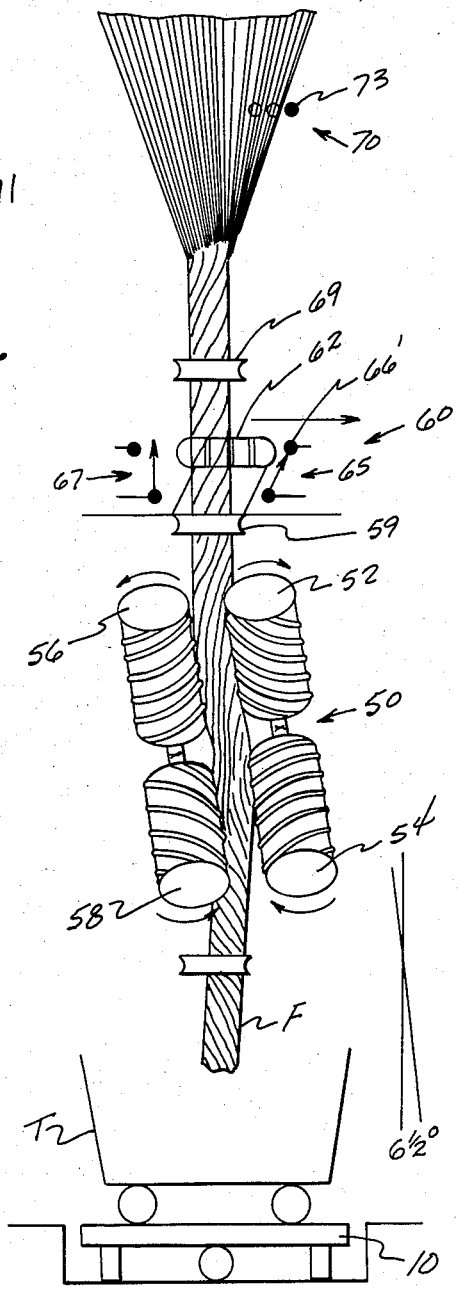
Fig. 3.
Fig. 4.

APPARATUS FOR REMOVING TWIST FROM MOVING FABRIC AND METHOD FOR ACCOMPLISHING SAME

BACKGROUND OF THE INVENTION

The present invention relates to a method and apparatus for the removal of real or false twist from a moving fabric in rope form.

Fabric that is subjected to finishing and/or dyeing processes in rope form such as in a jet dyer or the like is subject to receiving real or false twist during processing. Thereafter, upon removal of the fabric from the process equipment, it is necessary to open the fabric to full width such that it can be properly fed to a tenter frame or the like for drying and/or heat setting of the fabric. Either false or real twist in the fabric while in rope form will create problems during handling of same preparatory to feeding in open width to other process equipment. Particularly, with the fabric in rope form and loosely received in a container for same, a single end of the fabric is removed from the container for opening to full width. During such opening operation, spreading forces will cause any real or false twist therein to move along the fabric rope in a direction opposite the direction of opening. If adequate twist is present in the fabric, the fabric will ultimately become tangled in the container to a point where twist passes through the detwist unit and causes malfunctions of the spreader apparatus.

The present invention is designed to remove such real or false twist from a fabric in rope form prior to spreading, irrespective of the degree of twist in the fabric while enabling the process to continue unimpeded.

While detwist apparatus is known which includes rollers that engage the cloth and which are positively driven in circular fashion in a plane around the fabric path, there is no known prior art that is believed to anticipate or suggest the method or apparatus of the present invention.

SUMMARY OF THE INVENTION

It is an object of the present invention to provide apparatus for the removal of twist from a moving fabric in rope form.

Another object of the present invention is to provide apparatus for the removal of both real and false twist from a moving fabric in rope form, which apparatus is adjustable, dependent on the type and amount of twist in the fabric.

Another object of the present invention is to provide a means for controlling apparatus for removal of twist from a moving fabric.

Yet another object of the present invention is to provide an improved system for removing twist from a moving fabric in rope form under low tension conditions.

Yet another object of the present invention is to provide an improved system for removing twist from a moving fabric in rope form under tensioned conditions.

Still another object of the present invention is to provide an improved method for handling moving fabric in rope form to remove real or false twist therefrom.

Still another object of the present invention is to provide an improved method for controlling apparatus for removing real or false twist from a moving fabric.

Generally speaking, the detwist apparatus of the present invention comprises a first freely rotatable element located adjacent one side of a path of fabric travel and a second freely rotatable element positioned diagonally as to said first rotatable element adjacent an opposite side of said path of fabric travel, both said rotatable elements having fabric engagement means helically received therearound, and being capable of relative adjustment with respect to a fabric passing thereby.

Detwist apparatus of the present invention preferably comprises a first pair of freely rotatable elements disposed with respect to each other to form an acute angle therebetween, each of said elements having fabric engagement means located therearound that follow a helical path, the helical path on one of said elements being oppositely directed to the helical path on the other of said elements and a second pair of freely rotatable elements located laterally from said first pair of elements and defining a fabric treatment zone therebetween, said second pair of elements being disposed with respect to each other to form an acute angle therebetween, each of said elements having fabric engagement means located therearound that follow a helical path, the helical path on one of said elements being oppositely directed to the helical path on the other of said elements, and the helical paths on laterally opposite elements of each pair also being opposite.

More particularly, the two pairs of rotatable elements are preferably rollers mounted on a common support located parallel to the path of travel of the fabric. For fabric conditions where no significant twist is present, the fabric treatment zone between the pairs of rollers is likewise parallel to the path of fabric travel. In order to remove varying degrees of twist from the fabric, the common support is preferably rotatable about an axis perpendicular to the path of fabric travel in order to provide a tortuous path between the pairs of rotatable elements, the direction of rotation of the support being appropriate for removal of the twist in the fabric. Also any means for making adjustment to the rollers or fabric relative to each other may be employed to increase or decrease the twist removal capability.

In a preferred arrangement, a further means is located downstream from the fabric detwist means to ascertain the existence and direction of any twist remaining in the fabric after passage through the detwist means. Particularly, twist remaining in the fabric after passage through the detwister will act on the detector to move or deflect same. The twist detector is operatively associated with the detwist unit to indicate the appropriate direction of correctional adjustment when any such adjustment is dictated. Downstream of the twist detector means, the fabric is subjected to means to open same to full width. Located between the twist detector means and the point where the fabric is opened to full width is an openness sensing means. The openness sensing means is preferably a plurality of photocells that determine the degree of openess of the fabric at a particular location. In similar fashion to the twist detection means, the openness sensing means is operatively associated with the fabric detwist unit, and also with a turntable on which a container of fabric is located below the detwist unit. Depending upon the degree of openness of the fabric at the sensor location, the detwist unit will remain unchanged or will be further oriented in a direction indicated by the twist detection means to provide for appropriate twist removal. Further, should a significant amount of real twist remain in the fabric, rotation of the turntable will be implemented in a direction opposite the detected twist to still further assist in twist removal.

Generally speaking the method of removing twist from a moving fabric in rope form comprises the steps of bringing the fabric into contact with raised helical materials on diagonally opposite rotatable elements whereby the diagonally opposite rotatable elements rotate in opposite directions and the helical materials act on the fabric for removal of the twist.

More particularly, a preferred method of removing twist from a moving fabric according to the present invention comprises the steps of moving the fabric in rope form between two pairs of freely rotatable elements, each of said elements having a raised material located along a helical path therearound, the helical path on each adjacent rotatable element being opposite the direction of the helical path on each other adjacent element; monitoring said moving fabric downstream of said rotatable elements for twist remaining in said fabric; and maintaining the position of said elements with respect to said fabric then passing therebetween responsive to said monitored fabric.

Downstream monitoring of said fabric is preferably conducted in two operations. In a first operation the direction of any remaining twist is detected whereby the appropriate direction of any adjustment is determined. In a second operation, the amount of remaining twist, if any, is monitored to determine when, and the extent, of appropriate adjustment that should be made in the particular noted direction.

BRIEF DESCRIPTION OF THE DRAWINGS

FIG. 3 is a schematic illustration of a portion of the apparatus according to teachings of the present invention indicating orientation of the apparatus when little or no twists exist in the fabric.

FIG. 3*a* is a schematic illustration of a preferred remaining twist detecting photocell arrangement according to the present invention.

FIG. 4 is a schematic illustration of apparatus according to teachings of the present invention for removal of a slight amount of twist from the fabric.

DESCRIPTION OF THE PREFERRED EMBODIMENTS

Figure 1:
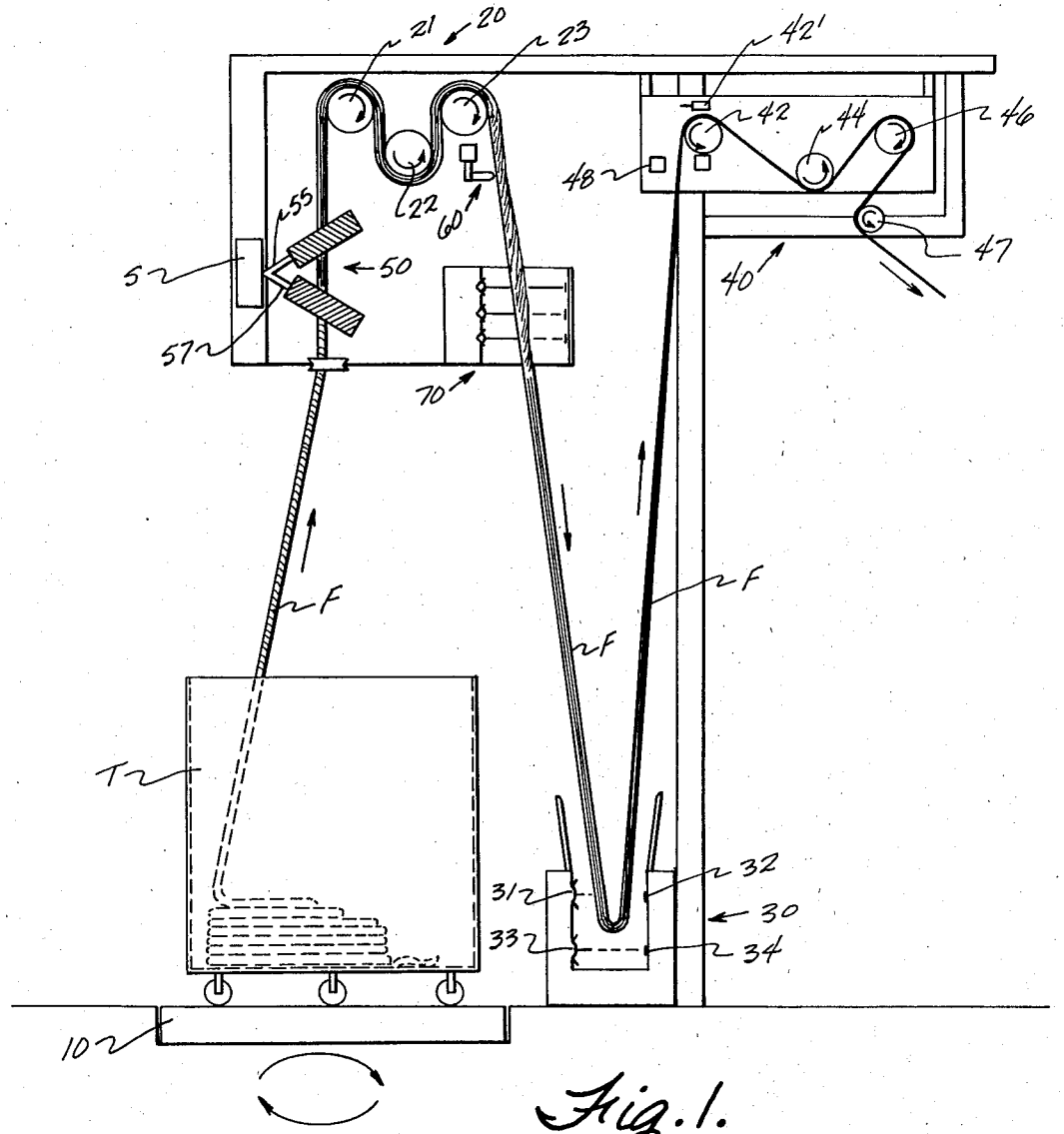
FIG. 1 is a schematic illustration of apparatus for removing twist from a moving fabric in rope form under low tension conditions according to teachings of the present invention.

Making reference to the Figures, preferred embodiments of the present invention will now be described in detail. FIG. 1 illustrates a preferred arrangement of apparatus according to the present invention for the removal of twist from a moving fabric in rope form under low tension conditions, and is particularly appropriate for fabrics that could be adversely effected by tension. A fabric F is shown threaded through the apparatus, originating in loose form in a fabric truck T that resides atop a turntable 10, the purpose of which will be described hereinafter. Fabric F is removed from within truck T, being lifted or pulled along a generally vertical path by s-wrap pull rolls generally 20 subsequent to which fabric F moves along a downward, generally vertical path into a loop control apparatus generally 30, and then along a second upward path to a fabric opening means generally 40. From opening means 40, fabric F is fed to such further processing equipment as is desired.

Fabric being subjected to the process and apparatus according to the present invention has previously been processed in rope form, such as in a dyeing or finishing operation, where due to the manipulation of the fabric within the operation, real or false twist is developed therein. Subsequently, in order to dry, heat treat or otherwise process the fabric, it is necessary to open same to full width. With real or false twist in the fabric rope, should one simply attempt to spread the moving fabric to full width, the twist in the fabric will move rearwardly with respect to the opening operation where ultimately the fabric will receive such a degree of twist that it becomes unmanageable, resulting in disruption of the system.

In order to remove twist from the rope fabric F, a detwist unit generally 50 is positioned along the path of fabric travel to act on the fabric and remove the twist. Detwist unit 50, as may best be seen in FIGS. 3 through 6, preferably includes a support S to which are mounted a pair of shafts 51, 53 that have rolls 52, 54 respectively mounted for free rotation thereon. As best seen in FIG. 1 an acute angle is formed between the shafts 51, 53 and consequently the rolls 52, 54. Each of the rolls has a raised material 52', 54' therearound, that follows a helical path along the length of the roll. As seen in FIG. 3, the direction of the helix for lead 52' is opposite the direction of helix for the lead 54'. A second pair of shafts 55, 57 are likewise secured to support S and extend outwardly therefrom forming an acute angle therebetween and having rolls 56, 58 freely rotatably received thereon. In similar fashion to rolls 52 and 54, rolls 56 and 58 likewise have raised material 56', 58' therearound which follows a helical path, the direction of the helices being opposite.

Figure 5:
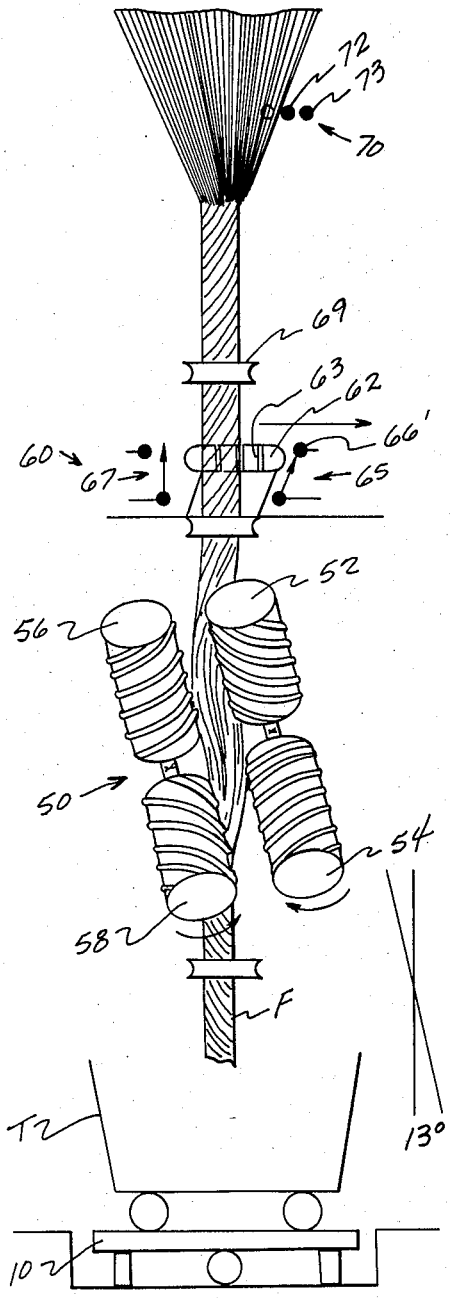
FIG. 5 is a schematic illustration of detwist apparatus according to the present invention for removal of a greater amount of twist from the fabric.
Figure 6:
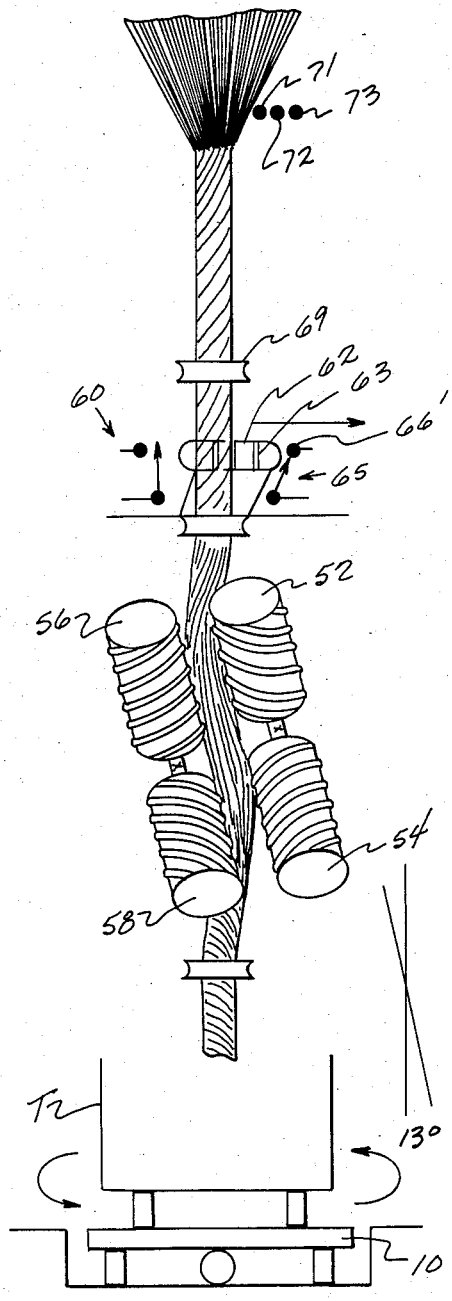
FIG. 6 is a schematic illustration of detwist apparatus according to teachings of the present invention for removal of real twist from the fabric.

As particularly shown in FIG. 3, the preferred two pairs of cylindrical elements or rolls 52, 54 and 56, 58 are laterally spaced apart to define a fabric path therebetween. Fabric passing between rolls 52, 54 and 56, 58 may engage the raised helical materials 52', 54', 56' and 58' of the rolls and impart rotation thereto during which the helical materials cause rotation of the fabric for twist removal. As likewise can be seen in FIG. 3, not only are the helical leads opposite for the rolls on each pair, but likewise each laterally opposite roll has an oppositely directed to helical path. With the arrangement as shown in FIG. 3 (neutral mode), very little, if any, twist exists in the fabric. Accordingly, no or little detwist action occurs. As can be seen in FIGS. 4, 5, and 6, and as will be further described hereinafter, the angular relationship between the detwist element and the path of fabric travel may be varied depending upon the direction and degree of twist present in the fabric.

Once fabric F leaves detwist unit 50, it passes around s-wrap pull rolls 21, 22, and 23 which provide the lifting force for fabric F to remove and convey same from truck T and through the detwist apparatus. Subsequent to s-wrap rolls 21, 22 and 23, fabric F begins a downward path of travel along which a twist sensor means 60 is located. Sensor means 60 is engaged by fabric F passing thereby for determining the existence and direction of any twist remaining in the fabric subsequent to passage through detwist unit 50.

Making reference to FIG. 3 a preferred embodiment of twist sensor means 60 is set forth. Particularly, an elongated element 62 having upstanding ribs 63 thereon is located across the path of travel of fabric F, with a longitudinal axis of element 62 being transverse to the direction of travel of fabric F. Sensor element 62 is associated with pivotal supports 64 which permit lateral movement of element 62 in either direction with respect to the path of fabric travel. Ribs 63 extend parallel to the path of fabric travel and any twist in fabric F engages ribs 63 and forces element 62 to pivot away from its original position, the direction of pivot being determined by the direction of the twist. An electric switch means generlaly 65, is located on one side of the path of fabric travel with a further switch means generally 67 on an opposite side. Each switch means is provided with a lever, pole or the like 66, 68 and contacts 66', 68' respectively which normally remain open. Movement of twist sensor element 62 in a lateral direction will bias pole 66 or 68 to actuate the particular electrical circuit associated therewith to input the direction of adjustment to be made, if any. The electrical circuit referred to is a control circuit that is operatively associated with support S such that once adequate additional twist is detected as described hereinafter, twist sensor 60, via the electrical circuit closed at either switch 65 or 67, dictates the direction in which the adjustment should be made. Such indicates that the detwist unit 50 has not removed all the twist from the fabric, that adequate twist remains to dictate corrective adjustment and that a tortuous path should be produced through detwist unit 50 in the indicated direction for more efficient twist removal. As illustrated in FIG. 4, adequate twist having been detected in fabric F to institute correctional adjustment, element 62 has been moved to the right to close switch 65 to thus bring about rotational movement of support S in a counterclockwise direction. Rolls 52 and 58 are thus brought into more intimate contact with fabric F for more efficient or greater removal of twist.

Subsequent to twist sensor 60 fabric F passes through a bullseye guide ring 69 and is thus subjected to fabric spreading means 74 which opens fabric F to full width. Should no twist or virtually no twist remain in fabric F, the fabric will begin spreading immediately upon leaving guide ring 69 as illustrated in FIG. 3. When, however, further twist remains in fabric F, the spreading action moves away from guide ring 69 depending upon the amount of twist remaining (see FIGS. 4–6). In other words, the spreading action on fabric F causes any remaining twist to move rearwardly away from spreader means 40 in the direction of guide ring 69 whereby the point of initial spread of the fabric moves upwardly in the direction of the spreader element 40 with increased remaining twist.

A further twist sensor element 70 is located between twist sensor 60 and spreader elements 40 to determine the amount of twist or degree of twist remaining in fabric F. Particularly, three photocells 71, 72, and 73 are illustrated in side by side fashion located along the path of fabric travel with the output of same being operatively connected to the control means for determining the appropriate amount of corrective rotation of support S, if any, and therefore the tortuousness of the path of travel of fabric F through the detwist unit 50. With a proper spread of fabric F as illustrated in FIG. 3, all three of the photocells 71, 72, and 73 are covered whereby no further adjustment to detwist unit 50 is required. As seen in FIGS. 4, 5, and 6, however, the uncovering of one or more of the photocells 73, 72, and 71 brings about a greater degree of angular adjustment of detwist unit 50 in a direction as determined by twist sensor means 60. When all three of the photocells are uncovered, turntable 10 is also actuated due to the magnitude of twist present in the fabric F.

As shown in FIGS. 4–6, z-twist (right hand twist) is detected in fabric F and a correctional counterclockwise rotation of support S is instituted for the removal of same from subsequent portions of fabric passing the detwist unit 50. Should an s-twist (left hand twist), however, have been detected then the reverse would be true, i.e. support S would rotate in a clockwise direction.

Fabric passing through the detwist unit 50 will encounter a neutral mode when little or no twist is present in fabric F. In the neutral mode, rolls of unit 50 are in parallel alignment with respect to the path of fabric travel (FIG. 3) in whereby little or no contact is made with fabric F. When a small amount of twist is present in fabric F, rolls 52, 54, 56, 58 are generally disposed as shown in FIG. 4 with respect to fabric travel, and in FIGS. 5 and 6 with greater amounts of twist. As can be appreciated, while roll adjustment herein is stepwise, i.e., 0 degrees, 6½ degrees, 13 degrees, any intermediate adjustments could be made using a greater number of photocells in openness sensing means 70. Likewise, infinitely variable adjustment could be similarly achieved.

With detwist unit 50 disposed for removal of twist, fabric makes primary contact with diagonally opposite rolls only, e.g. 52 and 58 or 54 and 56, depending upon the direction of twist. The basic detwist unit according to the present invention is thus two diagonally opposite rolls with adjustment made to the rolls individually or as a pair, or if desired by deflection of the fabric against the roll. With only two diagonally opposite rolls being employed, e.g. 52 and 58, greater adjustments must be made to realize the degree of flexibility attendant the preferred unit of four rolls as shown in the Figures. To reduce the amount of adjustment necessary for a two roll system, a pair of two roll systems could be employed, one being located after the other. In such an arrangement, one set of rolls should always be in the neutral mode.

As illustrated further in FIG. 1, the spreader unit 40 is not located immediately downstream of twist magnitude sensor 70, but is separated therefrom by a loop control system 30. Loop control system 30 is operatively associated with the s-wrap pull rolls 20. Particularly, loop control 30 includes a plurality of photocells 31, 33 in vertical alignment with corresponding receptors 32 and 34 on an opposite side of a space in which the fabric loop may be located. Loop control 30 is operatively associated with s-wrap rolls 20 such that depending upon the number of photocells that are operational due to the location of the fabric, the speed of the wrap rolls will increase or decrease proportionately such that a lower tip of fabric F is maintained in a generally common location. Such technology is well known in the art and the particularly preferred system for loop control 30 is described and claimed in the Young Jr.

U.S. Pat. No. 3,949,281 the description of which is incorporated by reference herein. The fabric F turns upwardly into its second upper leg in loop control 30 and moves upwardly to the means for spreading the fabric F to a full open width.

The fabric spreading means 40 may of course be any system that is designed to accomplish same, though a preferred system is described and claimed in the Young et al U.S. Pat. No. 4,068,789 the subject matter of which is incorporated by reference herein. Particularly, as to the Young et al system, such accomplishes a dual purpose of opening and centering the fabric such that same may be more accurately fed to a subsequent processing machine, wound into roll form, or the like. Such system includes a driven scroll roll or the like 42 that receives fabric from the loop control 30 with the fabric passing thereover and with the scroll roll 42 driven in a direction opposite direction of web movement as indicated by the arrow. Preferably roll 42 will include two helical elements of opposite pitch that originate along a medial portion of the roll and extend outwardly therefrom whereby a spreading movement in opposite directions along the length of roll 42 will be achieved. In a much preferred arrangement, an edge detector means 48 is employed along one or both edges of the fabric, which are in operative association with a pressure application means 42' located above scroll roll 42 such that should edge sensor 48 detect an edge of fabric F outside of its intended path, pressure applicator means 42' is actuated to apply pressure against fabric F atop the scroll roll 42 to cause the fabric to be moved by the scroll roll in an appropriate corrective direction. A second scroll roll 44 is located adjacent scroll roll 42 and acts on an opposite side of fabric F passing thereby. Scroll roll 44 rotates in a direction coincident with the direction of fabric movement and preferably has a helical pitch opposite that of scroll roll 42. Furthermore, second scroll roll 42 is preferably driven a slightly faster rate than web travel to maintain the fabric F at approximately tensionless conditions. Further rolls 46 and 47 are guide rolls that assist in directing fabric to further processing stations.

The fabric control system overall as described with respect to FIG. 1 is of particular interest in handling lightweight flimsy fabrics at very low tension or tensionless conditions such that the fabrics while being detwisted, spread to an open width, and centered is not distorted or otherwise changed from the original state of the fabric structure. Moreover, with the loop control system determining the speed of the fabric through the detwisting segment of the apparatus, as opposed to a tension condition to be described hereinafter, the system is not as dependent on height, and may be constructed in very compact fashion.

Figure 2:
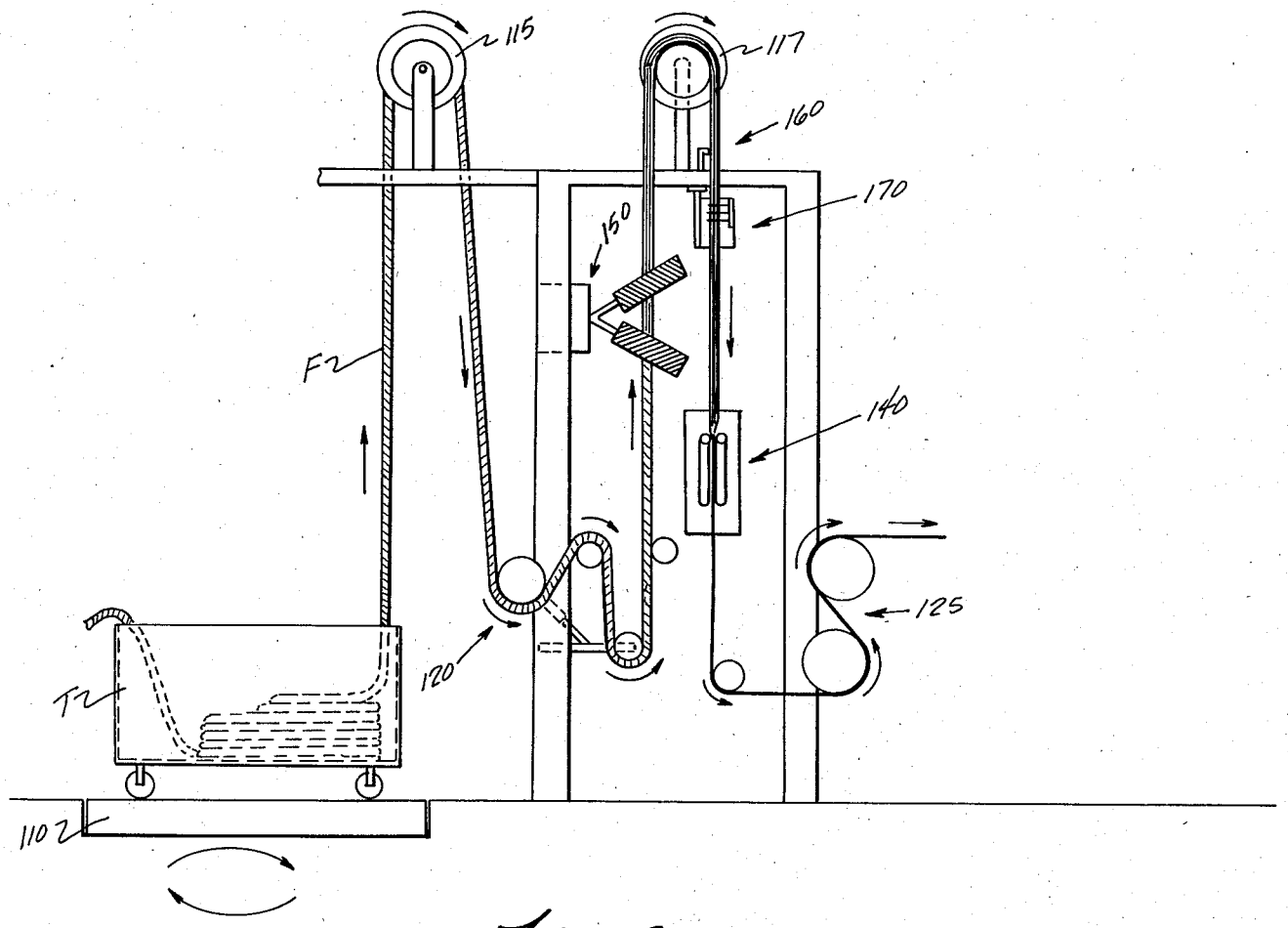
FIG. 2 is a schematic illustration of apparatus for removing twist from a moving yarn in rope form under tensioned conditions according to teachings of the present invention.

FIG. 2 illustrates a control system arrangement in which the fabric is handled under tension while being detwisted and spread to an open width form prior to being transported to a takeup means or further processing station, neither of which are shown. In the arrangement according to FIG. 2, the fabric F in rope form is delivered to the equipment in a truck T which resides on a turntable 110 that is capable of rotational movement in either direction. The fabric moves vertically upwardly around a first guide roll 115 then downwardly through a pneumatically operated dancer system generally indicated as 120 where it turns upwardly along a second vertical path and passes a detwist unit generally 150 of the type as described with respect to FIG. 1. The fabric then passes over a second idler roll 117 and extends downwardly along a second downward path past a twist sensor generally 160 and a twist magnitude sensor generally 170. Thereafter, the fabric is under the influence of a spreader element generally 140. A pull or drive roll system generally 125 is employed downstream of fabric spreader 140 and is used to pull the fabric F through the entire system which of course creates the tensioned conditions referred to. As opposed to the tensionless handling system as described with respect to FIG. 1, the tension system of FIG. 2 is height dependent, in that, a fabric being spread in the second downward leg between the twist magnitude sensor 170 and the spreader elements 140 requires significant height at operational speeds to permit the fabric to assume the spread condition. In fact a height in the neighborhood of 20–25 feet is required between the upper end of idler roll 117 and the lower side of the pull rolls 125.

The detwist unit 150, the twist sensor 160, and the twist magnitude sensor 170 are as described with respect to FIG. 1 and same will not be repeated at this point.

Making specific references to FIGS. 3–7, certain detwist operational states and the control system therefor will be described. As is apparent from the Figures, the physical relationship between the detwist unit 50, the twist sensor 60 and the twist magnitude sensor 70 are not as shown in FIGS. 1 and 2. Instead they are simply shown in an in line positional relationship for explanatory purposes, though from a standpoint of functionality the system would work as illustrated. FIG. 3 illustrates a fabric F passing vertically upwardly between two pairs of freely rotatable cylindrical elements 52, 54 and 56, 58 where the pairs of cylindrical elements are positioned parallel to the path of travel of the fabric F. In this arrangement, there is no twist in fabric F as the fabric enters the detwist unit 50. Accordingly there would be no corrective measures made and, in fact, there would be little or no contact between fabric F and the freely rotatable cylindrical elements of either pair. Subsequent to passage through detwist unit 50, the fabric F still with no twist therein encounters the twist sensor 60. Since no twist is present, the sensor element 62 remains in position such that electrical switches 65 and 68 remain open. Again no corrective control measures are initiated at support S. The fabric then passes through guide element 69 and emerges therefrom under the influence of a spreader element not shown such that the spread of fabric F at the twist magnitude sensor generally 70 is adequate to cover photocells 71, 72, and 73, indicating no twist and a proper spreading of the fabric. Again no corrective measures would be instituted. As shown in FIG. 3*a*, in a preferred arrangement, the photocell 71 directs light across the path of fabric travel onto a reflective surface R. If a fabric is passing therebetween the light will not be reflected back to the photocell indicating no corrective action, whereby the electrical switches associated with the photocells will remain deactuated.

In FIG. 4, the fabric F entering detwist unit 50 has a slight amount of twist therein. Actually with the detwist unit having been in the attitude as shown in FIG. 3, no twist would be removed from fabric F. Once, however, fabric F encounters the twist sensor head 60, the z-twist appearing in the fabric will engage the ribs 63 on sensor element 62 forcing same to the right till switch 65 is made. Closing of switch 65 will then implement the appropriate directional correction to be made for the detwist units, should one or more of the photocells be exposed to initiate correctional action. As shown in FIG. 4, photocell 73 is exposed whereby support S has been rotated counterclockside such that the pairs of cylindrical elements 52, 54, and 56, 58 assume a position as shown which is approximately 6½ degrees from vertical. In such configuration, fabric F will engage diagonally opposite rolls 52 and 58 and interact with helical leads 52' and 58' whereby rolls 52 and 58 rotate in the direction as shown by the arrows and fabric F is rotated by the effect of the helical leads to remove twist therefrom. Further, with the fabric having passed through detwist unit 50 without all of the twist having been removed, as shown in FIG. 4, during the spreading operation, photocell 73 remains exposed and support S will remain at the 6½ degree orientation.

As illustrated in FIG. 5, z-twist is likewise present in fabric F, downstream of detwist unit 50 indicating counterclockwise correctional direction if change is to be made. As opposed to FIG. 4, however, photocells 72 and 73 remain uncovered indicating a greater degree of twist remaining in fabric F such that support S has been oriented to position rolls 52 and 58 approximately 13 degrees from vertical. Again primary fabric contact is with rolls 52 and 58 though since the tortuous passageway created through the detwist unit is greater in FIG. 5 than in FIG. 4, a greater pressure is exerted between fabric F and rolls 52 and 58 such that a greater amount of twist would be removed.

FIG. 6 illustrates an operational state where a still greater degree of twist remains in fabric F such that all of the photocells remain uncovered. In this arrangement, and with the z-twist shown in the fabric, support S would remain at or be rotated approximately 13 degrees from vertical. Additionally turntable 10 would be actuated, and rotated to assist in removal of twist from fabric F.

FIGS. 4–6 indicate optional states and/or corrective measures for fabrics containing z-twist therein. It should be pointed out that should the twist have been an S twist, the twist direction sensor 60 would have been moved or deflected to the left whereby electrical switch 68 would have been made in lieu of switch 65. In such case, the rotation of support S of the detwist unit 50 would have been clockwise instead of counterclockwise. Likewise, under the circumstances as illustrated in FIG. 6 where all three of the photocells 71, 72, and 73 remain uncovered, the turntable would have rotated in a clockwise direction as opposed to a counterclockwise direction as shown.

Figure 7:
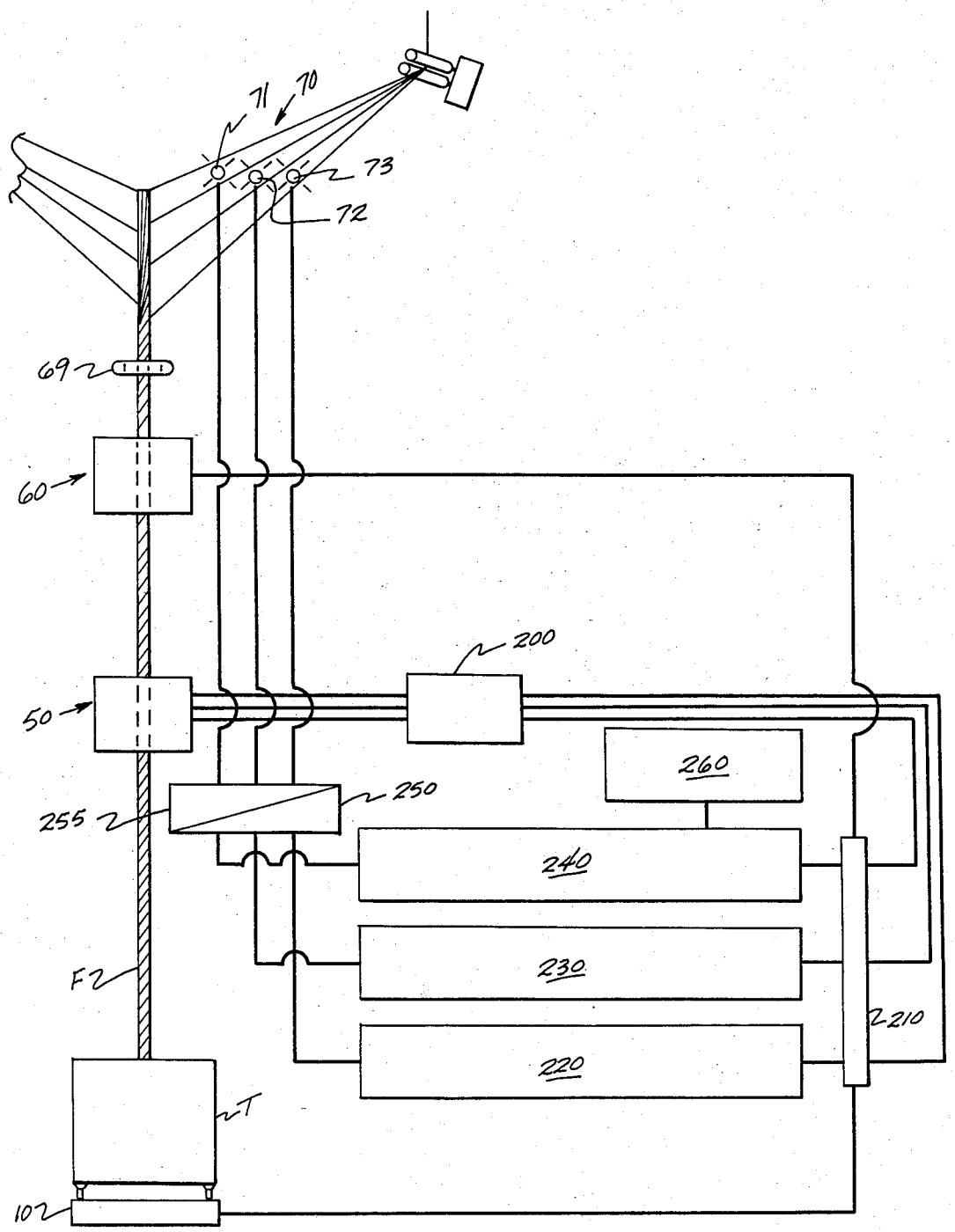
FIG. 7 is a control logic diagram for the apparatus of the present invention.

FIG. 7 schematically illustrates the operative association between the control elements of the present invention. The particular electrical components or circuitry of same are not illustrated since the actual construction of same from the information provided herein is believed to be within the provisions same are believed to be of those skilled in the art. As shown in FIG. 7, the rotational position of detwister unit 50 is dictated by control unit 200, both as to amount and direction of rotation. Such could, for example be a pneumatic actuator operatively associated with support S. With no photocells of sensor 70 uncovered, fabric F remains in an adequately twistless state such that no corrective measures are required, even should twist direction sensor 60 indicate the presence of twist. Under such conditions, detwist unit 50 remains in a neutral mode. Exposure of photocell 73 of magnitude sensing means 70 indicates adequate remaining twist to justify some correction. Exposure of photocell 73 thus actuates control actuator 220 which provides an input signal to unit 200 indicating need for a particular degree of rotation for detwist unit 50. Twist direction sensor 60 will have input the appropriate direction of rotation. Control unit 200 will then follow the input commands and, would rotate detwist unit 50 6½ degrees counterclockwise (FIG. 4). Further corrective action would come about with exposure of photocells 71 and 72, with photocell 72 also actuating rotation of turntable 10 in a direction determined by twist sensor 60.

With a control unit as schematically illustrated in FIG. 7, the degree and timing of rotation may be adjusted according to the dictates of the overall system. For example, while 6½ and 13 degree rotational increments are discussed with respect to FIGS. 3 through 6, such amounts may of course vary. In like manner, an infinitely variable adjustment system could be employed. It is of course preferred that detwist unit 50 not undergo continuous adjustment. Accordingly, a time delay unit 250 is located between the photocells of sensor 70 and the individual control actuators 220, 230, and 240 to afford a flutter dampening characteristic for the system. In other words, a delay occurs between exposure of the photocells and input to control unit 200 to ensure that the twist condition removes and that exposure did not result from fabric flutter or the like.

Should magnitude sensor 70 indicate a need for correctional adjustment of detwist unit 50 to remove more or less twist, care must be taken to ensure that a false reading has not been obtained, thus avoiding undesirable oscillations. Control circuit 205 is thus provided in control unit 200 to avoid change resulting from false sensings. Particularly a change from a detwist mode to the neutral mode (FIG. 3) could enable twist backed up in fabric F upstream of detwist unit 50 to surge through detwist unit 50 and foul the system. To avoid such, when input is received to return to the neutral mode from a detwist mode, e.g. 6½ or 13 degrees orientation, control circuit 205 will institute a time sequence during which detwist unit will switch back and forth between the then present and suggested orientation. If the condition remains after the particular time interval, the suggested change will be made. If, however, the condition does not so remain, detwist unit 50 is returned to its present orientation.

Also referring to FIG. 7, when photocell 71 is exposed, and actuator 240 initiates rotation of detwist unit 50 and rotation of turntable 10, the control system for turntable 10 is preferably arranged for cyclic movement. For example, in a preferred arrangement turntable 10 rotates for about 30 seconds and stops for about 12 seconds. The 12 second deley enables further fabric F to reach sensor 70 for a determination of whether twist continues to remain in fabric F. Turntable control system 240 is also preferably equipped with a safety switch 260 whereby the system is inoperable until switch 260 is actuated to enable control system 240. Inadvertent rotation will thus not occur when an operator could be injured by the rotation.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. Apparatus for removing twist from a moving fabric in rope form comprising: a pair of freely rotatable elements located along opposite sides a path of fabric travel, each of said rotatable elements having fabric engagement means located therearound and following a helical path, said elements being diagonally disposed to each other along said path; and means to adjust said elements relative to a fabric passing therebetween, whereby fabric coming into engagement with said fabric engagement means inparts rotation to said elements while said fabric engagement means imparts rotation to said fabric.

2. Apparatus as defined in claim 1 wherein a pair of said rotatable elements is located along each side of said path, each pair of rotatable elements defining an acute angle therebetween and the helical path for said fabric engagement means being oppositely directed for the elements of each pair.

3. Apparatus as defined in claim 2 wherein said pairs of elements are mounted on a common support, said support being rotatable for adjustment of said elements with respect to said fabric.

4. Apparatus as defined in claim 3 comprising further twist sensor means located downstream of said elements and being operatively associated with said support whereby said support may be rotationally positioned dependant upon twist sensed in said fabric downstream of said elements.

5. Apparatus as defined in claim 4 wherein said twist sensor means comprise first means for determining the direction of twist remaining in said fabric and second means for determining the amount of twist remaining in said fabric.

6. Apparatus for removing twist from a moving fabric in rope form comprising:

(a) a first pair of freely rotatable elements disposed with respect to each other to form an acute angle therebetween, each of said elements having fabric engagement means located therearound that follow a helical path, the helical path on one of said elements being oppositely directed to the helical path on the other of said elements;

(b) a second pair of freely rotatable elements located laterally from said first pair of elements and defining a fabric treatment zone therebetween, said second pair of elements being disposed with respect to each other to form an acute angle therebetween, each of said elements having fabric engagement means located therearound that follow a helical path, the helical path on one of said elements being oppositely directed to the helical path on the other of said elements, the helical paths on laterally opposite elements of the pairs also being opposite; and (c) means to adjust said elements relative to a fabric passing therebetween.

7. Fabric detwisting apparatus as defined in claim 6 wherein said first and second pairs of elements are mounted on a common support, said support being adjustable.

8. Fabric detwisting apparatus as defined in claim 7 wherein said support is rotationally adjustable to vary the attitude of said elements with respect to a fabric passing therebetween.

9. Fabric detwisting apparatus as defined in claim 8 comprising further twist detection means located downstream with respect to said pairs of rotatable elements and control means operatively associated with said twist detection means and said support, whereby said pairs of rotatable elements may be adjusted with respect to fabric passing thereby to compensate for any twist detected in the fabric after it leaves the effect of the rotatable elements.

10. Fabric detwisting apparatus as defined in claim 9 wherein said twist detection means comprises first means to sense the direction of any twist remaining in said fabric and control means operatively associating said twist direction sensing means and said support, and second means to sense the amount of twist remaining in said fabric and control means operatively associating said second means and said support, whereby upon detection of a predetermined amount of twist remaining in said fabric, said support is rotated by a predetermined amount in an appropriate direction for removal of such twist from further fabric portions passing between said rotatable elements.

11. Fabric detwisting apparatus as defined in claim 6 wherein said elements are rollers.

12. Fabric detwisting apparatus as defined in claim 11 wherein said fabric engaging means secured to said rollers along a helical path protrudes outwardly from said rollers and wherein adjacent segments of said fabric engaging means are spaced apart along the length of said roller.

13. Apparatus for removing twist from a moving fabric in rope form comprising:

(a) a support;

(b) a first pair of cylindrical elements freely rotatably associated with said support at one end and extending outwardly therefrom, said pair of elements defining an acute angle therebetween; said elements having a fabric contact member secured thereto and following a helical path therearound, the direction of the helix around one of said elements being opposite the direction of the helix on the other of said elements;

(c) a second pair of cylindrical elements freely rotatably associated with said support at one end and extending outwardly therefrom, said pair of elements defining an acute angle therebetween, said elements having a fabric contact member secured thereto and following a helical path therearound, the direction of the helix around one of said elements being opposite the direction of the helix around the other of said elements, said first and second pairs of elements defining a fabric path of travel therebetween whereby when said pairs of elements are aligned generally axially with respect to fabric movement thereby generally no twist is removed and when said pairs are positioned to contact said fabric, interaction between the moving fabric and the elements removes twist from the fabric; and (d) means to adjust said elements relative to a fabric passing therebetween for proper twist removal.

14. Fabric detwisting apparatus as defined in claim 13 comprising further fabric twist direction sensing means located downstream with respect to said cylindrical elements and being contactable by said fabric, and control means operatively associating said sensing means and said support, and means located downstream of said direction sensing means for determining the amount of twist remaining in said fabric, and control means operatively associating said amount of twist determining means and said support, whereby upon detection of adequate twist remaining in said fabric after leaving said pairs of cylindrical elements said control means will implement predetermined rotation of said support in an appropriate direction for removal of such twist from further fabric portions passing between said cylindrical elements.

15. Fabric detwisting apparatus as defined in claim 14 wherein said twist direction sensing means comprises a moveable element located in the path of fabric travel and electrical actuator means located adjacent opposite edges of same, said actuator means being operatively associated with said control means.

16. Fabric detwisting apparatus as defined in claim 15 wherein said means for determining the amount of twist remaining in said fabric comprises a plurality of photocells located along the path of travel of said fabric, the numbr of photocells exposed determining the amount of twist remaining in said fabric.

17. Apparatus for handling a moving fabric in rope form comprising:

(a) means for moving said fabric along a path of travel;

(b) means located along said path of travel engagable by said fabric for removing twist therefrom as defined in claim 1;

(c) means located along said path of travel downstream of said twist removal means for detecting the existence and direction of twist remaining in said fabric;

(d) means located along said path of travel downstream of said twist detection means for determining the amount of twist remaining in said fabric, said twist detection means and said amount of twist determining means being operatively associated with said twist removal means to control said twist removal means responsive to twist determined in said fabric for removal of same, if any, from further fabric portions acted on by said twist removal means.

18. Apparatus as defined in claim 17 wherein said twist removal means comprises diagonally opposite freely rotatable elements located on opposite sides of said path of fabric travel, said elements having fabric contact members received therearound along a helical path, the helical path of the fabric contact member on one element being the same direction of the helical path on the other diagonally opposite element.

19. Apparatus as defined in claim 17 wherein two pairs of rotatable elements are mounted on a common support on opposite sides of said path of fabric travel, said elements of each pair being associated to define an acute angle therebetween, the helical paths for fabric contact members on the elements of each pair being oppositely directed.

20. Apparatus as defined in claim 17 wherein said means for moving said fabric comprise roll means for pulling said fabric through said twist removal means and a loop control means located downstream of said roll means, said loop control means being operatively associated with said roll means to control the speed of same whereby said fabric may be handled under low tension conditions.

21. Apparatus for handling a moving fabric in rope form under low tension conditions and for opening same comprising:

(a) means for pulling said fabric in a generally vertical path and permitting said fabric to fall along a downward path on an opposite side of same;

(b) means for lifting said fabric from its downward path, and along a second upward path whereby a fabric loop is formed, said means acting on said fabric at a top of said second upward path to open same to full width;

(c) means located along said first upward path of fabric travel and engagable by said fabric for removing twist therefrom;

(d) means located downstream of said twist removal means for detecting any twist remaining in said fabric;

(e) means located downstream of said twist detection means for determing the amount of twist remaining in said fabric, said twist detection means and twist measurement means being operatively associated with said twist removal means for controlling said twist removal means responsive to the detection of twist and the amount of twist then remaining in fabric after passage through said twist removal means; and (f) loop control means located at a lower end of said downward path of fabric travel, said loop control means being operatively associated with said fabric pulling means to control the speed of same.

22. A method for removing real or false twist from a moving fabric in rope form comprising the steps of;

(a) providing diagonally opposite freely rotatable spaced apart elements along a path of fabric travel, said elements having fabric contact members received therearound along a helical path, the helical path on one of said elements having a same direction as the helical path on the other of said elements; and (b) moving said fabric along said path of travel between said elements whereby said fabric contacts said fabric contact members and imparts rotation to said elelments, while said helical fabric contact members imparting rotation to said fabric whereby twist is removed from said fabric.

23. The method as defined in claim 22 wherein said elements are adjustable with respect to said path of travel for removal of differing amounts of twist from said fabric.

24. The method as defined in claim 22 comprising further;

(c) contacting said fabric downstream of said elements to determine the existence and direction of any twist remaining in said fabric;

(d) determining the amount of any remaining twist in said fabric; and (e) controlling said elements dependent upon the direction and amount of remaining twist in said fabric whereby said elements will remove more or less twist from further portions of said fabric passing therebetween, responsive to said remaining twist and the direction of same.

25. The method as defined in claim 24 wherein said fabric is located on a rotatable support, and wherein upon detection of twist remaining in said fabric, said rotatable support is oriented in an appropriate direction to assist in removal of twist.

* * * * *